United States Patent [19]

Ikeda et al.

[11] Patent Number: 4,688,648

[45] Date of Patent: Aug. 25, 1987

[54] METHOD OF AND APPARATUS FOR CRUSHING EARTH UNDER THE GROUND

[75] Inventors: Taro Ikeda; Teruo Yahiro; Hiroshi Yoshida; Kenji Nishi; Takahisa Isobe; Yoichi Kume; Hidenobu Hamano, all of Tokyo, Japan

[73] Assignee: Kajima Corporation, Tokyo, Japan

[21] Appl. No.: 737,642

[22] Filed: May 24, 1985

[30] Foreign Application Priority Data

May 25, 1984 [JP] Japan ..... 59-104655

[51] Int. Cl.[4] ..... E21B 7/18

[52] U.S. Cl. ..... 175/242; 175/67; 175/424; 299/17

[58] Field of Search ..... 175/67, 69, 205, 231, 175/238, 242, 267, 292, 422; 299/17

[56] References Cited

U.S. PATENT DOCUMENTS

| | | | |
|---|---|---|---|
| 2,018,285 | 10/1935 | Schweitzer et al. | 175/67 |
| 4,278,137 | 7/1981 | Van Eek | 175/267 |
| 4,302,052 | 11/1981 | Fischer | 175/67 |
| 4,366,988 | 1/1983 | Bodine | 175/267 |
| 4,494,616 | 1/1985 | McKee | 175/67 |
| 4,508,389 | 4/1985 | Hodges | 175/67 |

*Primary Examiner*—Stephen J. Novosad
*Assistant Examiner*—William P. Neuder
*Attorney, Agent, or Firm*—Armstrong, Nikaido, Marmelstein & Kubovcik

[57] ABSTRACT

Method and apparatus for crushing the earth under the ground by boring a hole; inserting a drill head having radially directed water jet thereon down the hole to the desired stratum; rotatingly moving the drill head upwardly while jetting water radially to form a cylindrical crushed area; lowering the drill head to the original depth; extending a water jet extender arm radially to a projecting position; again rotatingly moving the drill head upwardly while jetting water from the nozzles on the radial outward portions of the extender arm to radially enlarge the cylindrical crushed area, the rotation of the extender arm also stirring the already crushed area; returning the extender arm to an original waiting position; and lifting the drill head out of the hole.

2 Claims, 9 Drawing Figures

METHOD OF AND APPARATUS FOR CRUSHING EARTH UNDER THE GROUND

BACKGROUND OF THE INVENTION

1. Field of the Invention

The present invention relates to a method of and an apparatus for crushing earth and sand located in a certain depth under the ground.

2. Prior Art

Oil is drawn up, for example from oil sand or heavy oil beds which are formed in layers under the ground. The oil sand bed which is exposed on the ground can be easily excavated, and oil is extracted from the oil sand thus collected. When the oil sand bed is located relatively deep under the ground, a certain area of the oil sand bed is crushed and oil to be extracted is separated from the sand generally by an electrically preheating system in which AC current is conducted in the crushed area filled with salt water or by a steam heating system in which steam is introduced under pressure into the crushed area. In these cases, it is desired to crush the oil sand bed as widely as possible for effectively drawing up a maximum amount of the oil. Furthermore, as the oil sand bed expands in the lateral or transverse direction in comparison with the vertical direction, it desired to extend the crushing in the lateral direction as far as possible.

There has been proposed a method of forming a cylindrically crushed area under the ground for hardening a foundation or driving a concrete pile by inserting a pipe carrying a drill head into a hole bored in the earth, injecting water at a high speed from nozzles directed in the lateral direction of the drill head, and rotatingly moving the pipe upwardly, as is well known in the prior art as exemplified in Japanese Patent Publication No. 54-41001, U.S. Pat. Nos. 404,758 and 4,084,648 and Japanese Patent Publication No. 57/055849. However, because water jet has a limited path length, such a method is useful only to crush a cylindrical area of radius 1 m at the utmost, when it applied for crushing, for example, an oil sand bed. Consequently, many holes must be bored in the earth to get a crushed area spreading laterally. When the oil sand bed lies, for example, 500 m below the surface of the earth, many holes must be quite uneconomical bored to that depth.

OBJECT AND SUMMARY OF THE INVENTION

It is, accordingly, an object of the present invention to provide a method of and an apparatus for crushing a large area under the ground by boring a hole in the earth and inserting into the hole a drill head which is expansible laterally.

According to the present invention, there is provided a method of crushing a large cylindrical area under the ground, comprising the steps of boring a hole in the earth; inserting a hydraulic drill head into the hole; rotatingly moving the hydraulic drill head upwardly while jetting water radially thereform so as to form a cylindrical crushed area; lowering the hydraulic drill head and extending water jet extender arm to its projecting position; again rotatingly moving the hydraulic drill head upwardly while jetting water radially from the projecting extender arm to radially enlarge the cylindrical crushed area; and lifting the hydraulic drill head from the hole, after the extender arm is returned to its waiting position.

Furthermore, there is provided an apparatus for crushing the earth under the ground by being inserted into a hole bored in the earth and jetting water radially outwardly to crush the area radially outside of the hole, comprising a framework disposed on the surface of the earth and adapted for vertically movably supporting a pipe; a device for rotating the pipe; a hydraulic drill head provided at the lower end of the pipe; water jetting nozzles attached to the hydraulic drill head and adapted for jetting water radially outwardly; a device for projecting the water jetting nozzles radially outwardly; a high pressure water pump device for supplying high pressure water to the water jetting nozzles; and a hydraulic pump device for applying pressurized oil to the device for projecting the water jetting nozzles radially outwardly for operating the same.

ADVANTAGE OF THE INVENTION

At first, a cylindrical crushed area with a relatively small radius is formed by upward movement of the hydraulic drill head, and then the cylindrical crushed area is enlarged in radius by water jetted from the nozzles at their projecting position. Thus, a large crushed area is formed in the earth through only one hole.

In the apparatus according to the present invention, as water injection for crushing is executed twice, namely through the nozzles at the waiting position and through the nozzles at the projecting position, the hydraulic drill head inserted into a hole is useful to form a crushed area of an enlarged radius. Therefore, for example, when oil is extracted from the oil sand, the apparatus is quite effective to form a relatively large crushed area in the earth.

As a relatively wide crushed area is obtained according to the present invention, the crushed area may be filled with gravel or the like after the abrading or hole-enlarging operation, which improves permeability and penetration of the oil sand and heavy oil as well as prevents intrusion of the sand in the oil sand bed S into the well so as to effectively draw out additional oil.

PREFERRED EMBODIMENTS OF THE INVENTION

A hole is preliminarily bored by, for example, an earth auger or a hydraulic drill head provided with a bit and/or water jetting nozzles at the lower end thereof.

The water jetting nozzles are preferably mounted on the radially outside ends of an extender arm so as to fully stir the first crushed area by the second upward movement of the hydraulic drill head for facilitating the subsequent operation such as extraction of oil from the oil sand by a conventional method. The extender arm is preferably projected by means of a hydraulic cylinder. The nozzles for jetting water radially outwardly may be provided on both the outer periphery of the hydraulic drill head body and the extreme ends of the extender arm or only on the extreme ends of the extender arm.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF THE PREFERRED EMBODIMENTS

Figure 1:
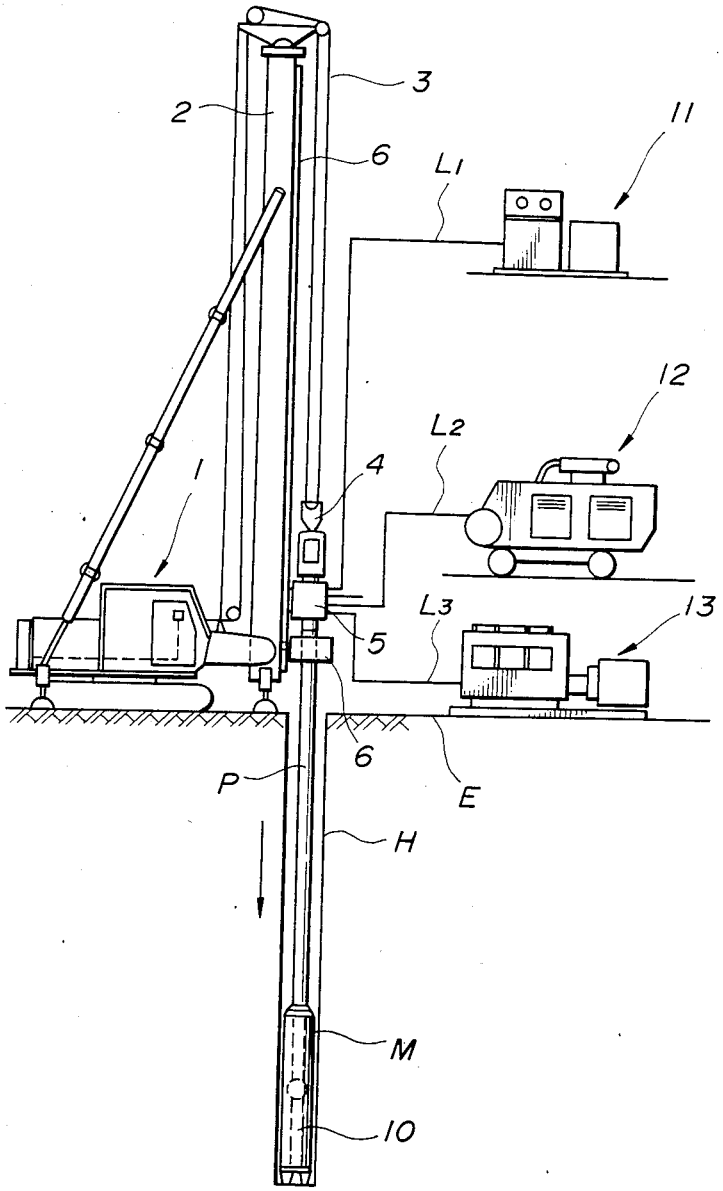
FIG. 1 is a side view of an apparatus according to the present invention, showing a hole being bored.

Referring now to the drawings, a first embodiment of the present invention will be described.

In FIG. 1, a hole H is bored from the surface of the earth E by an apparatus according to the present invention having a framework 1. The framework 1 has a post 2 which is pivotally movable and is shown standing uprightly. A drill cable 3 hangs down along the post 2, holding a hanging means 4 vertically movably along the post 2. A swivel joint 5 is attached to the lower portion of the hanging means 4 and vertically movable along the post 2, engaging with a guide 6 provided on the post 2. A hollow rod or drill pipe P is attached to the swivel joint 5, and rotatably gripped, at the upper end thereof in the drawing, by a rotating device 7 provided in the vicinity of the lower end of the post 2. A hydraulic monitor or drill head M which will be described hereinbelow is attached to the lower end of the drill pipe P.

On the surface of the earth E, there are provided a hydraulic pump device 11 for supplying pressurized oil to a cylinder unit for operating a water jet extender arm 10 of the hydraulic drill head M which will be described hereinbelow, a compressor device 12 for supplying an air jet which entrained in the water injected for crushing, as is disclosed in the above-mentioned prior arts, and a high pressure water pump device 13 for injecting water. These devices 11, 12 and 13 have a hydraulic line L1, an air line L2 and a high pressure water line L3, respectively, which are connected through the swivel joint 5 to their respective lines (not shown) provided within the drill pipe P and then to the hydraulic drill head M.

In operation, the hydraulic drill head M has at the lower end thereof a bit and water jetting nozzles for boring. When the drill pipe P is rotated by the rotating device 6, the earth under the hydraulic drill head M is abraded. As the drill cable 3 is lowered, the drill pipe P moves downwardly, boring the hole H. When the upper end of the drill pipe P comes near the rotating device 6, as shown in the drawing, the drill pipe P is detached from the swivel joint 5. The drill cable 3 is wound up. The drill pipe P is connected to another piece of drill pipe having its lower end connected to the upper end of the drill pipe P and its upper end engaged with the swivel joint 5. Now, the above operation is repeated to bore a deeper hole H, until it reaches, for example, an oil sand bed S (FIG. 2).

Figure 2:
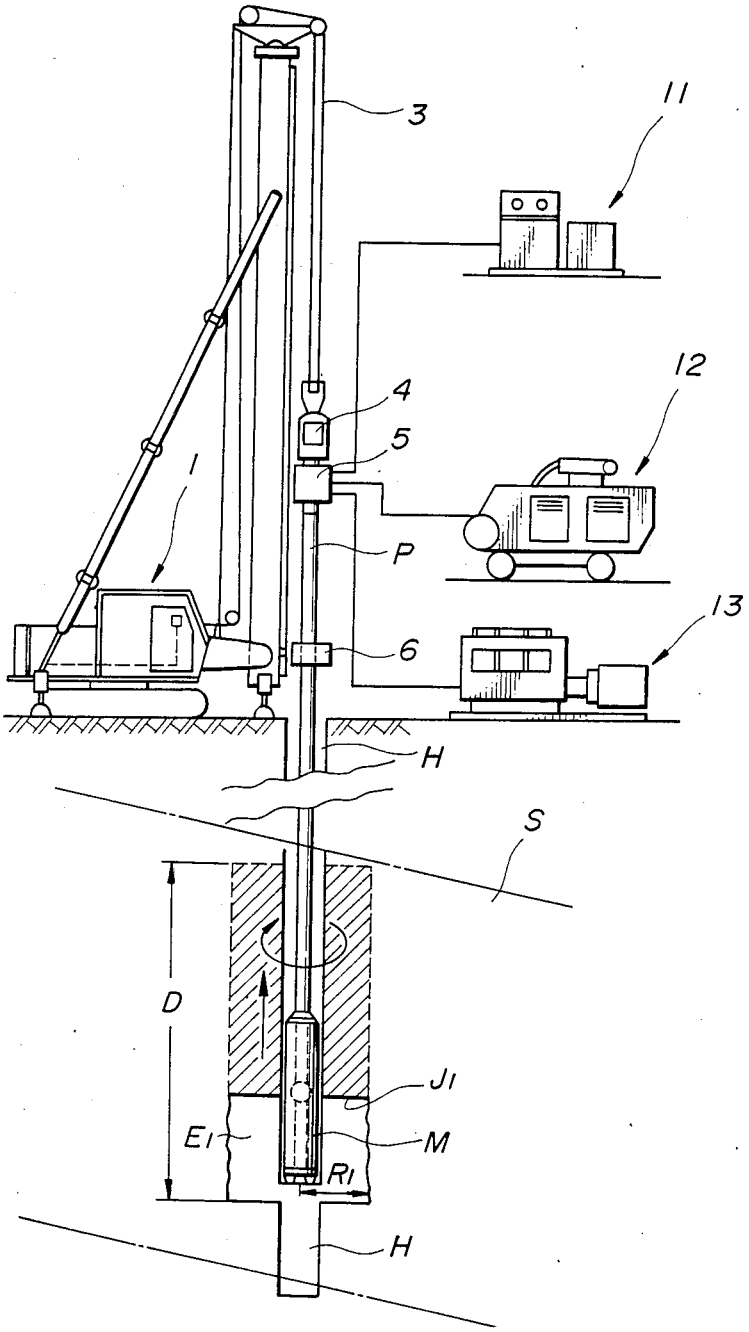
FIG. 2 is a side view of the apparatus, illustrating the crushing operation by water jetting when the extender arm is at the first waiting position.

When the bored hole H reaches a predetermined position, as shown in FIG. 2, the high pressure water pump device 13 and the compressor device 12 are activated to radially outwardly jet the water jet J1 entrained with air from the hydraulic drill head M. At the same time, the hydraulic drill head M is rotated by activation of the rotating device 6 and lifted by the drill cable 3. As the result, a cylindrically crushed area E1 is formed containing a slurry of water, air and oil sand having a radius corresponding to the path length of the water jet J1. Upward travel of the hydraulic drill head M continues to a predetermined crushing distance D (preferably the distance substantially corresponding to the thickness of the oil sand bed S).

Figure 3:
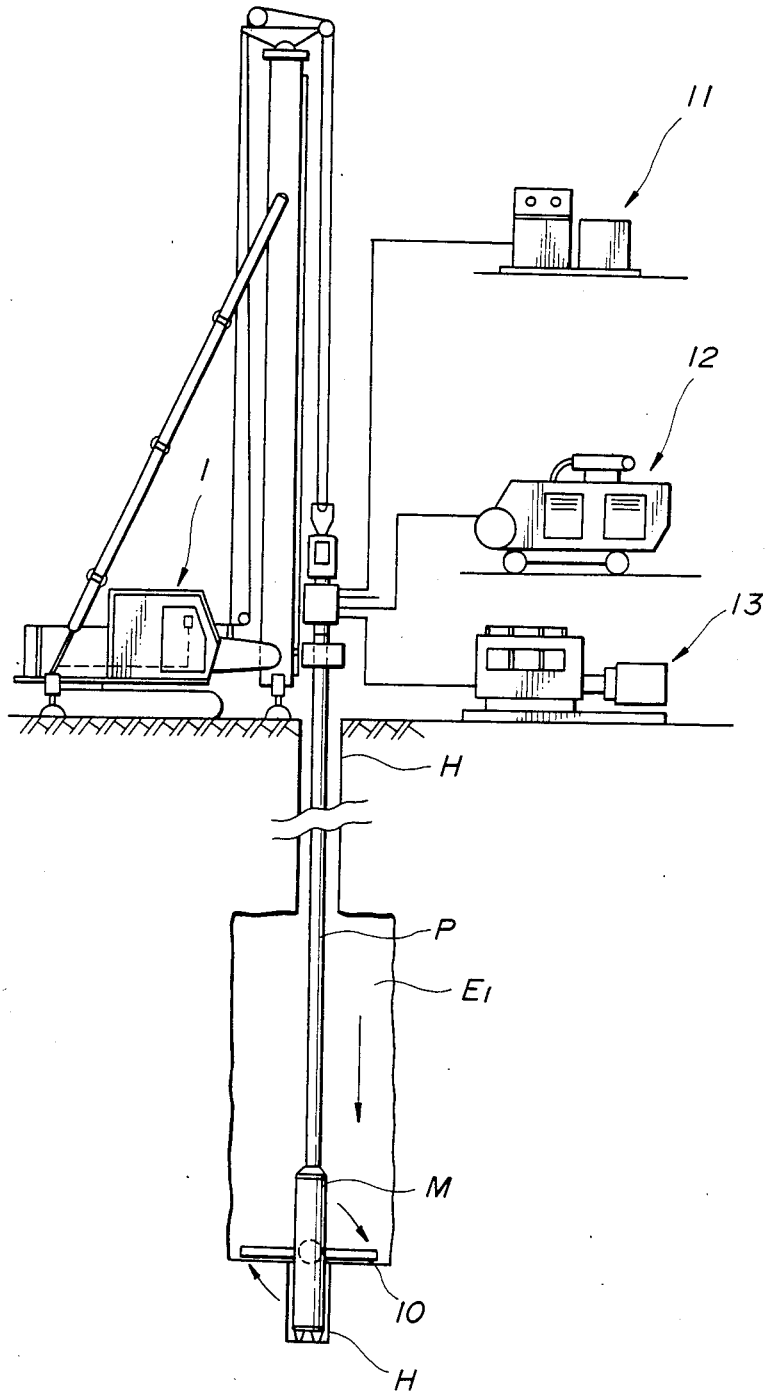
FIG. 3 is a side view of the apparatus illustrating the crushing operation by water jetting when the extender arm is at the second projecting position.
Figure 4:
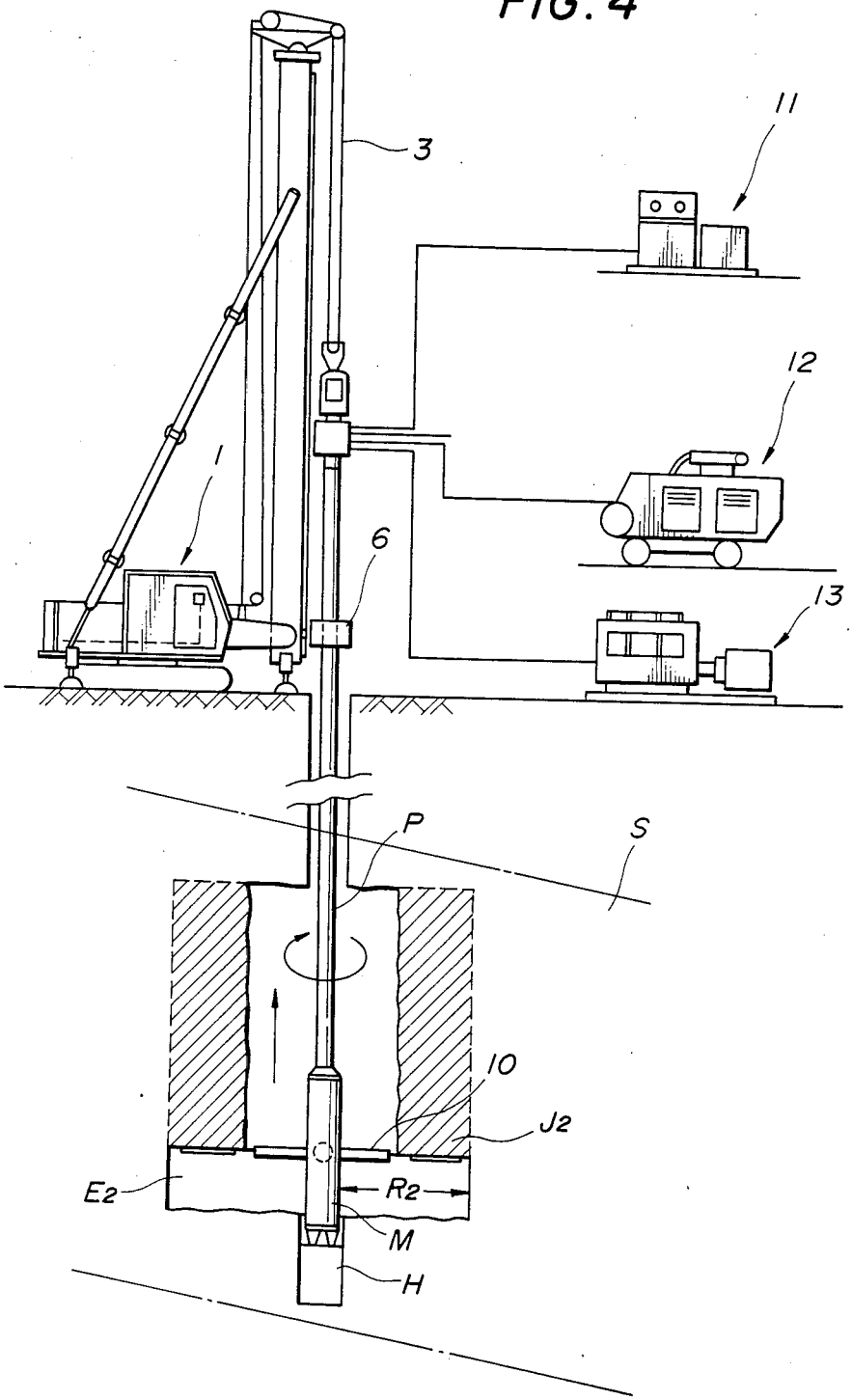
FIG. 4 is a side view of the apparatus illustrating the enlarged crushed area due to water jetting from the extender arm.

After the cylindrical crushed area E1 of radius R1 and height of D is formed, the hydraulic drill head M is moved down to the bottom of the hole H, as shown in FIG. 3. Then, the hydraulic pump device 11 is activated to project the stirring rod or water jet extender arm 10 radially outwardly as shown in the drawing. The extender arm 10 provides two functions, namely, extending the reach of the water jets and simultaneously stirring the already formed mixture of oil sand, water, oil, sand, and air. The projection length of the extender arm 10 is almost the same or slightly shorter than the path length of the water jet J1 or the radius R1 of the cylindrical area E1. Nozzles are provided at both of the projecting ends of the extender arm 10. As described referring to FIG. 2, the hydraulic drill head M is rotatingly lifted. In this case, however, water jet J2 is jetted from the extreme ends of the extender arm 10, as shown in FIG. 4. As the result, a cylindrically crushed area E2 of an enlarged radius R2 is formed, and at the same time, the crushed area, such as the oil sand, is stirred by the extender arm 10.

Figure 5:
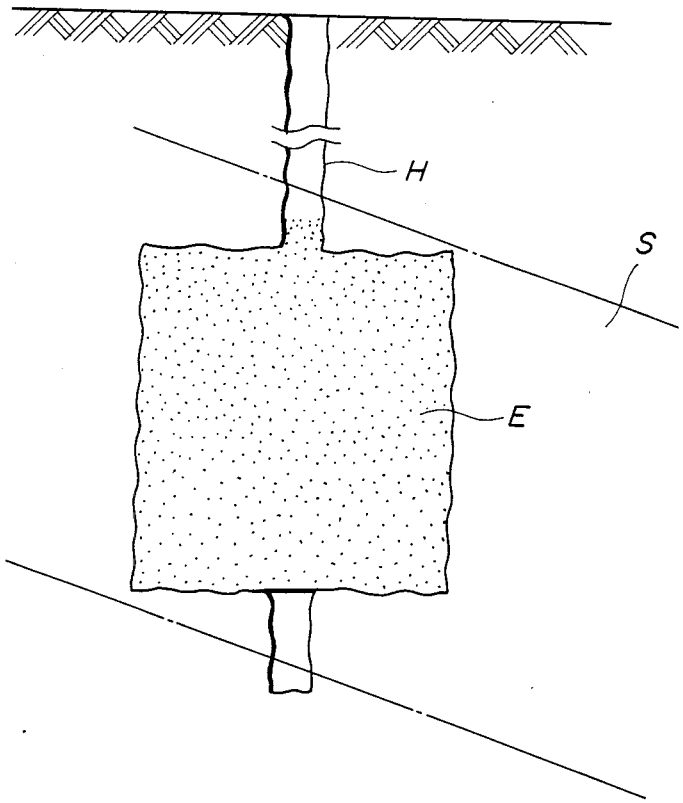
FIG. 5 is a side view of the apparatus, illustrating the crushed area finally obtainable by the apparatus.

After the cylindrical crushed area E2 of the enlarged radius is formed, as shown in FIG. 5, the extender arm 10 is returned to the position shown in FIG. 1 and the hydraulic drill head M is lifted out of the hole H to finish the operation.

Figure 6:
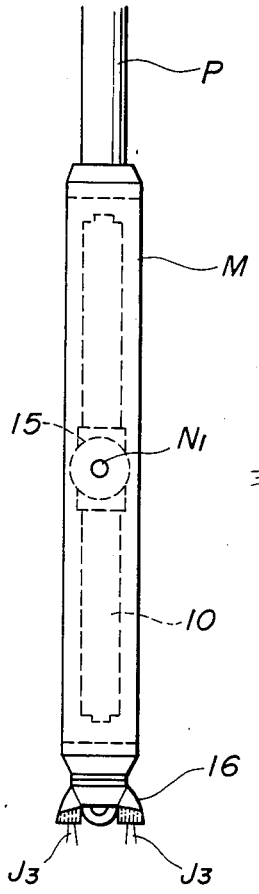
FIG. 6 is a side view of an embodiment of the hydraulic drill head in which the extender arm is at the first waiting position.
Figure 7:
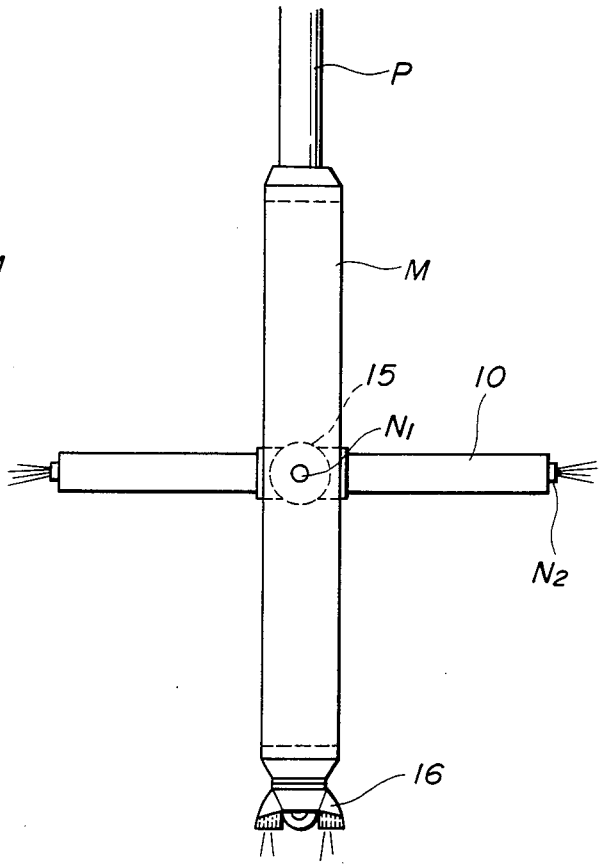
FIG. 7 is a side view of the hydraulic drill head shown in FIG. 6, in which the extender arm is at the second projecting position.

FIGS. 6 and 7 are enlarged side views of the hydraulic drill head M shown in FIG. 1. The hydraulic drill head M has, at its lower end, a boring bit 16 provided with water jetting nozzles for boring the hole H. When the hydraulic drill head M rotates, the bit 16 abrades the bottom of the hole H, supported by the water jet J3. A first set of nozzles N1 are provided at the central portion of the hydraulic drill head M, diametrically disposed to each other. The extender arm 10 is pivotally movable by a rotary driver 15 between a first waiting position shown in FIG. 6 and a second projecting position shown in FIG. 7. A second set of nozzles N2 are provided at each extreme end of the extender arm 10. This pivotal movement of the extender arm 10 is caused by a cylinder unit (not shown) through the pressurized oil supplied from the hydraulic pump device 11. There is provided a switching valve (not shown) which serves to supply high pressure water to the first set of nozzles when the extender arm 10 is at the first position, and to the second set of nozzles when the extender arm 10 is to the second position shown in FIG. 7. Preferably, the switching valve is operatively associated with the rotary driver 15.

Figure 8:
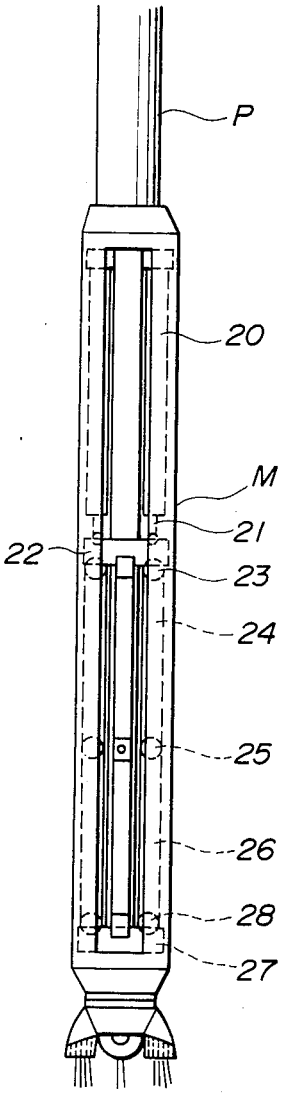
FIG. 8 is view of another embodiment of the hydraulic drill head in which the extender means is at the first waiting position.
Figure 9:
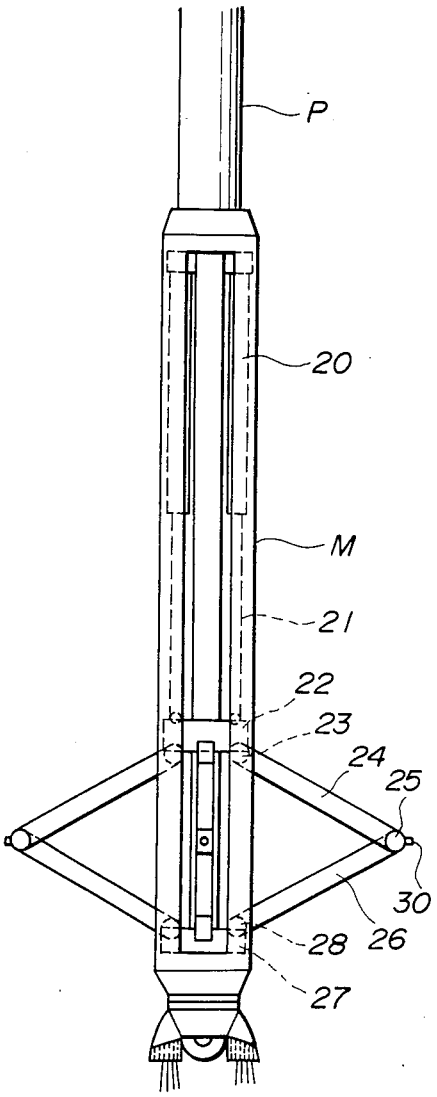
FIG. 9 is a side view similar to FIG. 8, in which the extender means is at the second projecting position.

FIGS. 8 and 9 show another embodiment of the hydraulic drill head M. At least one hydraulic cylinder 20 is operated by pressurized oil supplied from the hydraulic pump device 11 and has a piston therein connected to a piston rod 21 which is connected to a ring block 22 at the top end thereof. A first link 24 has one end pivotally mounted to the block 22 through a pivot pin 23 and the other end pivotally mounted to one end of a second line 26 through a pivot pin 25. The other end of the second link 26 is pivotally mounted through a pivot pin 28 to a pivot block 27 fixed on the body of the hydraulic drill head M. The linkage thus constructed by the first and the second links 24 and 26 is movable between the first position and second position through pressurized oil supplied into or ejected from the hydraulic cylinder 20. In this embodiment in the drawing, four sets of linkages are disposed at right angles to one another and a nozzle 30 is provided at each pivot pin 25. Means (not shown) are provided to supply water and air to each nozzle 30.

The hydraulic drill head thus constructed operates in the same way as that according the above-mentioned first embodiment.

It is readily apparent that the above-described method of and apparatus for crushing earth under the ground meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An apparatus for crushing the earth under the ground by being inserted into a hole bored in the earth and injecting water radially outwardly to crush the area radially of the hole, comprising a framework disposed on the surface of the earth and adapted for vertically movably supporting a pipe; a device attached to the framework for rotating the pipe; a hydraulic drill head provided at the lower end of the pipe; water jetting nozzles attached to the hydraulic drill head and adapted for jetting water radially outwardly; a device for projecting the water jetting nozzles radially outwardly; a high pressure water pump device supplying high pressure water to the water jetting nozzles; and a hydraulic pump device for applying pressurized oil to the device for projecting the water jetting nozzles radially outwardly, said device including an arm having two ends and a middle portion, said nozzles being mounted on said ends and said arm being pivotally mounted at said middle portion to said drill head to project said two ends outward to a position extending radially from said drill head.

2. An apparatus according to claim 1, wherein said device for projecting the water jetting nozzles radially outwardly comprises a pivot block attached to said drill head, a ring block slidably mounted on said drill head, and a plurality of pivotable linkages connected between said pivot block and said ring block, each said linkage including a first link having one end pivotally connected to said ring block, a second link having one end pivotally connected to said pivot block, and a link pin pivotally joining the other ends of said first and second links, said nozzles being mounted on said pivot pins.

* * * * *